United States Patent [19]

Wyatt

[11] 4,437,081

[45] Mar. 13, 1984

[54] ROCKING ARMATURE TRANSFORMER RELAY

[75] Inventor: Gerald A. Wyatt, Shoreview, Minn.

[73] Assignee: Minnesota Mining and Manufacturing, St. Paul, Minn.

[21] Appl. No.: 453,834

[22] Filed: Dec. 28, 1982

[51] Int. Cl.[3] ..... H01F 7/08

[52] U.S. Cl. ..... 335/229; 335/234

[58] Field of Search ..... 335/229, 230, 234, 236, 335/304; 361/209, 208

[56] References Cited

U.S. PATENT DOCUMENTS

| | | | |
|---|---|---|---|
| 3,461,354 | 8/1969 | Bollmeier . | |
| 3,775,715 | 11/1973 | Bosch et al. | 335/234 X |
| 4,134,090 | 1/1979 | Schuessler et al. | 335/229 |
| 4,223,290 | 9/1980 | Agatahama et al. | 335/229 |
| 4,321,652 | 3/1982 | Baker . | |

*Primary Examiner*—George Harris

*Attorney, Agent, or Firm*—Donald M. Sell; James A. Smith; William D. Bauer

[57] ABSTRACT

An electromagnetic device with a ferromagnetic coil having first and second legs completing a closed magnetic circuit. An armature is pivotably mounted on a flux return bracket for optionally contacting the ferromagnetic core at two locations. Latching magnets cooperating with the flux return bracket retain the armature against the ferromagnetic coil at either of those two locations. A gap is provided between the armature in the ferromagnetic core at the location opposite from the location where the armature contacts the ferromagnetic core. A source of operating flux cooperates with the ferromagnetic core for selectively establishing a magnetic flux across such gap which may then operatively pivot the armature to contact the ferromagnetic core at the second location thereby creating a gap between the armature and the ferromagnetic core at the first location.

3 Claims, 3 Drawing Figures

ROCKING ARMATURE TRANSFORMER RELAY

BACKGROUND OF THE INVENTION

The present invention relates generally to magnetic remote control switches and more particularly to low voltage transformer relays.

A variety of magnetic remote control switches exist in the art. Some of these magnetic remote control switches incorporate a transformer along with an electromagnetic structure. Such a combination structure allows a switching system to be remotely controlled from low voltage switches connected to the secondary of the transformer. Typically, these structures are then called low voltage transformer relays.

Two primary examples of these low voltage transformer relays are described in U.S. Pat. No. 3,461,354, Bollmeier, Magnetic Remote Control Switch and U.S. Pat. No. 4,321,652, Baker et al, Low Voltage Transformer Relay. In both structures a transformer is provided within an electromagnetic structure. The transformer has a primary winding (coil) and a secondary winding (coil). The primary winding is connected to a source of alternating current, e.g. a 60 hertz power source. The electromagnetic structure contains an armature which is magnetically stable in either of two positions. The armature carries or activates a set of contacts which contains load carrying contacts. With the secondary winding of the transformer open, the electromagnetic device remains stable in its prior position. Bidirectional switches can be coupled in parallel, either directly or through an interface circuit, to the secondary winding of the electromagnetic device. The bidirectional switches can be activated to restrict the current flowing in the secondary winding to either a first or a second direction switching the transformer relay to either a first or a second position, thus operating the load carrying contacts.

Both the Bollmeier and Baker et al low voltage transformer relays are constructed in a three leg configuration with an armature mounted for movement between opposed pole faces. One leg of the ferromagnetic core contains the primary winding or coil, a second leg of the ferromagnetic coil contains a secondary winding or coil. The third leg contains a gap defined by opposed pole faces with the armature disposed in the gap between the opposed pole faces.

SUMMARY OF THE INVENTION

An electromagnetic device is provided having a ferromagnetic core having first and second legs completing a closed magnetic circuit. An armature is pivotably mounted in the electromagnetic device for optionally contacting the ferromagnetic core. The armature and the ferromagnetic core define a gap between the ferromagnetic core and the armature at the opposite side of the armature from which the armature is contacting the ferromagnetic core. A flux return bracket is mounted in the electromagnetic device between the pivotably mounted position of the armature and the ferromagnetic core. A source of latching flux cooperates with the ferromagnetic core, the flux return bracket and the armature for retaining the armature in contact with the ferromagnetic core. A source of operating flux cooperates with the ferromagnetic core for selectively establishing a magnetic flux across the gap. In this manner, the armature may be pivotably moved from contact with the ferromagnetic core on one side of the second leg to contact with the ferromagnetic core on the other side of the second leg.

In a preferred embodiment, the source of operating flux includes a primary coil wound around the first leg of the ferromagnetic core and a secondary coil wound around the second leg of the ferromagnetic core. The primary coil is adapted to be coupled to an alternating current power source. The secondary coil is adapted to be coupled across a rectifying switch for allowing a unidirectional current flow in the secondary coil and for selecting the direction of that current flow.

Such an electromagnetic device provides several significant advantages.

The resultant electromagnetic device results in much simpler ferromagnetic core shape. A ferromagnetic core formed in such a shape is the result of a much simpler lamination structure. The structure uses a single commercial "L " type of ferromagnetic core. Such a ferromagnetic core is more inexpensive than the cores required in the Bollmeier and Baker et al low voltage transformer relays and uses more readily available, standard components.

The electromagnetic device of the present invention is also more compact. Since only two ferromagnetic core legs are required as opposed to the three required in the Bollmeier and Baker et al low voltage transformer relays, the design is more compact and the smaller structure can be fitted into a smaller enclosure such as a junction box or a light fixture.

Further, the pivotably mounted (hence "rocking") armature has a greater range of motion and is more accessible for contact mounting than the armature mounted for moving between opposed pole faces as described in Bollmeier and Baker et al. Such a pivotably mounted armature is more suitable for use with a double throw electrical switch.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
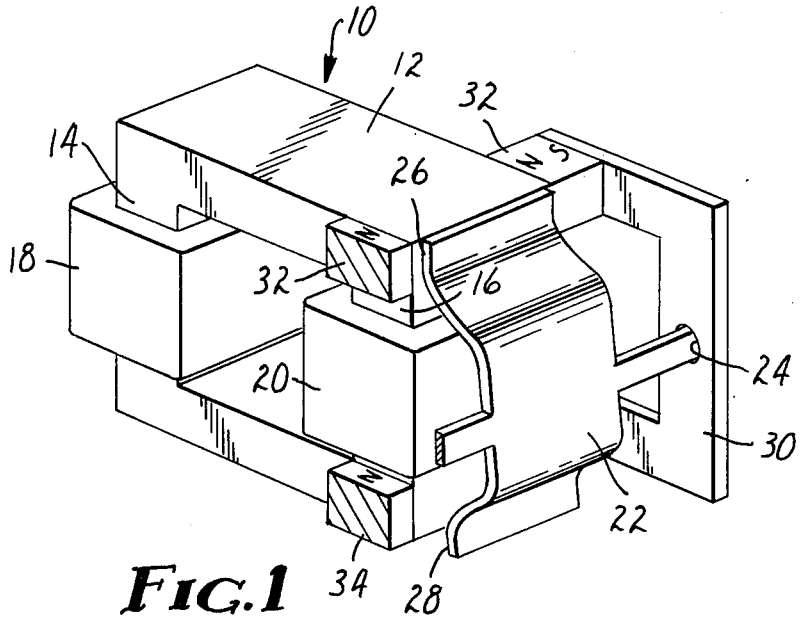
FIG. 1 is an isometric view of the electromagnetic device of the present invention.
Figure 2:
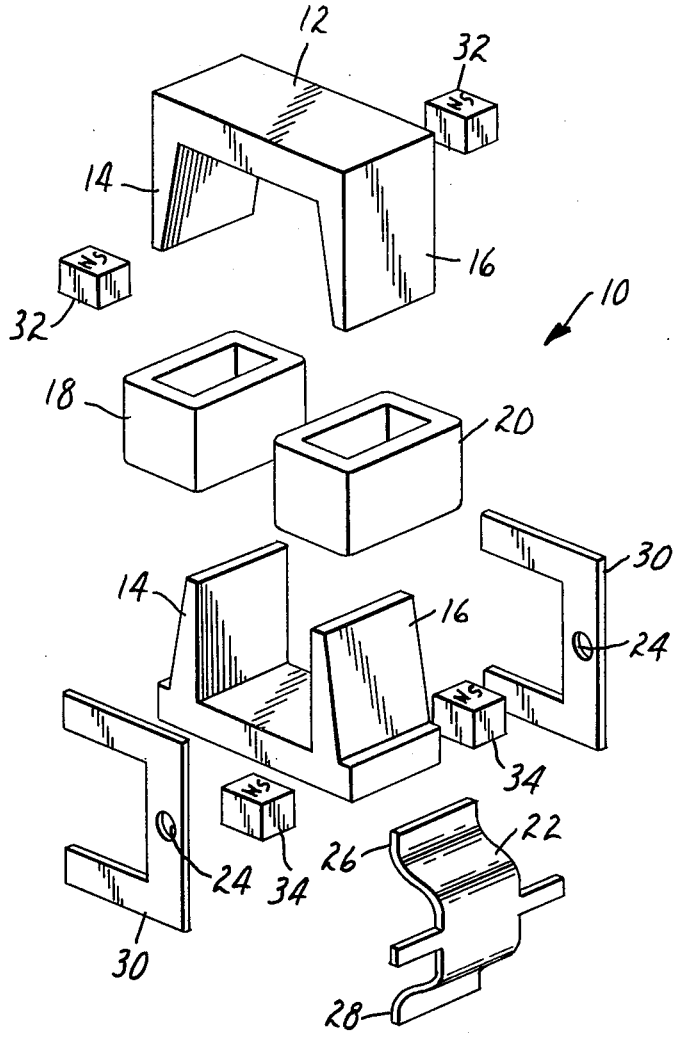
FIG. 2 is an explosion of the electromagnetic device of FIG. 1.

FIGS. 1 and 2 illustrate an isometric view and an explosion view of the electromagnetic device of the present invention, respectively. The electromagnetic device 10 has a ferromagnetic core 12 with a first leg 14 and a second leg 16. A primary coil 18 is wound around the first leg 14 and a secondary coil 20 is wound around the second leg 16. An armature 22 is pivotably mounted at point 24 to alternately contact the ferromagnetic core 12 at either point 26 or 28. If armature 22 contacts the ferromagnetic core 12 at point 26, then a gap is established between the armature 22 and the ferromagnetic core 12 at point 28. Alternately, if the armature 22 contacts the ferromagnetic core 12 at point 28, a gap is established between armature 22 and the ferromagnetic core 12 at point 26. Armature 22 is pivotably mounted at point 24 to flux return bracket 30. Latching magnets 32 and 34 coupled between the ferromagnetic core 12 and the flux return bracket 30 retain the armature 22 against the ferromagnetic core 12 at either point 26 or 28.

Figure 3:
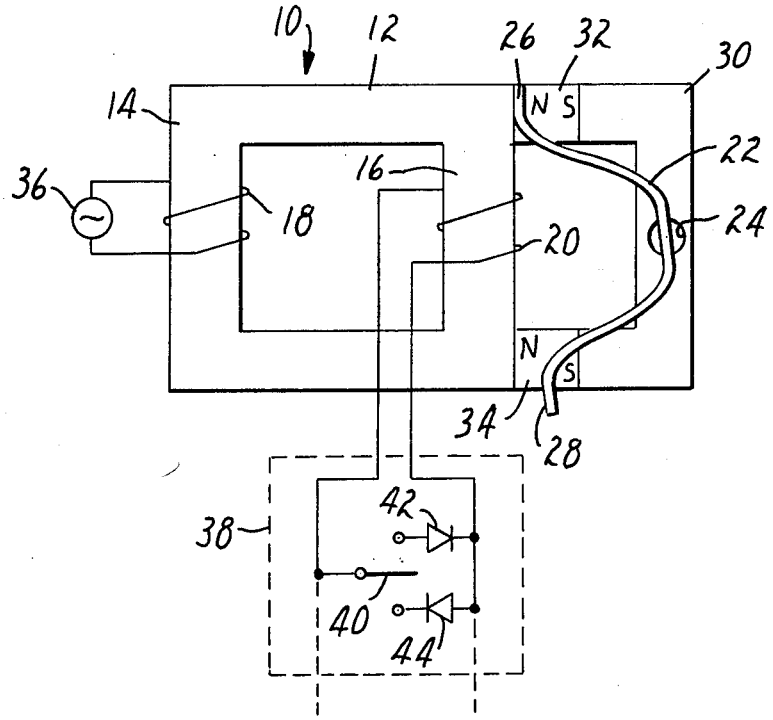
FIG. 3 is a magnetic schematic of the electromagnetic device of FIG. 1.

FIG. 3 represents a magnetic schematic of the electromagnetic device of FIGS. 1 and 2. Operation of the electromagnetic device 10 can be more readily understood by reference to the magnetic schematic of FIG. 3. Again, the ferromagnetic core 12 has a first leg 14 and a second leg 16. Primary coil 18 is wound around first leg 14 and is adapted to be connected to an alternating current power source 36. Secondary coil 20 is wound around second leg 16 and is adapted to be connected to a bidirectional switch 38. Bidirectional switch 38 contains a single pole, double throw, center off, momentary contact switch 40 and oppositely connected diodes 42 and 44. When single pole, double throw switch 40 is thrown to one contact or the other, either diode 42 or 44 is activated which allows only a unidirectional flow of current through secondary coil 20. A plurality of bidirectional switches 38 may be connected in parallel. Armature 22 is pivotably mounted at point 24 to flux return bracket 30. Flux return bracket 30 is mounted to the ferromagnetic core 12 with latching magnets 32 and 34. The armature 22 either contacts the ferromagnetic core 12 at point 26 which establishes a gap between the armature 22 and the ferromagnetic core 12 at point 28 or the armature 22 contacts the ferromagnetic core 12 at point 28 which establishes a gap between the armature 22 and the ferromagnetic core 12 at point 26.

As long as the bidirectional switch 38 is not activated the flux established in first leg 14 by the primary coil 18 may easily flow through second leg 16 with the ferromagnetic core 12 forming a closed magnetic circuit. Latching magnets 32 and 34 provide a flow of latching flux through the ferromagnetic core 12, the armature 22 and flux return bracket 30 to retain the armature 22 against the ferromagnetic core 12 at point 26. Latching magnets 32 and 34 would perform a similar function if the armature 22 were pivoted about point 24 to contact the ferromagnetic core 12 at point 28.

However, when the bidirectional switch 38 is activated, as for example by moving single pole, double throw switch 40 to the upper position activating diode 42, only a unidirectional flow of current is allowed through secondary coil 20. This unidirectional flow of current will provide a higher reluctance to flux flowing in one direction upwards through second leg 16 of the ferromagnetic core 12. The increased reluctance in second leg 16 will cause some of the operating flux supplied by primary coil 18 to transverse the gap at point 28 between the armature 22 and the ferromagnetic core 12. When the flux transversing the gap at point 28 and conducted through armature 22 back to forromagnetic core 12 exceeds the latching flux supplied by latching magnets 32 and 34, the armature 22 will pivot about point 24 to contact the ferromagnetic core 12 at point 28. With the subsequent deactivation of bidirectional switch 38, the armature 22 will be retained against the ferromagnetic core 12 at point 28 by latching magnets 32 and 34. A similar but reverse operation will occur if the bidirectional switch 38 is activated by moving single pole, double throw switch 40 to the lower position activating diode 44.

Thus, it can be seen that there has been shown and described a novel electromagnetic device. It is to be understood, however, that various changes, modifications and substitutions in the form of the details of the electromagnetic device can be made by those skilled in the art without departing from the scope of the invention as defined by the following claims.

What is claimed is:

1. An electromagnetic device, comprising:

a ferromagnetic core having first and second legs completing a closed magnetic circuit;

an armature pivotably mounted in said electromagnetic device for optionally contacting said ferromagnetic core; said armature and said ferromagnetic core defining a gap between said ferromagnetic core and said armature at the opposite side of said ferromagnetic core from the side of said ferromagnetic core at which said armature is contacting said ferromagnetic core;

a flux return bracket mounted in said electromagnetic device between said pivotably mounted position of said armature and said ferromagnetic core;

a source of latching flux cooperating with said ferromagnetic core, said flux return bracket and said armature for holding said armature in contact with said ferromagnetic core; and a source of operating flux cooperating with said ferromagnetic core for selectively establishing a magnetic flux across said gap;

whereby said armature may be pivotably moved from contact with said ferromagnetic core one side of said armature to contact with said ferromagnetic core on the other side of said armature.

2. An electromagnetic device as in claim 1 wherein said source of operating flux comprises:

a primary coil wound around said first leg of said ferromagnetic core, said primary coil adapted to be coupled to an alternating current power source; and a secondary coil would around said second leg of said ferromagentic core, said secondary coil adapted to be coupled across a rectifying switch means for allowing a unidirectional current flow in said secondary coil and for selecting the direction of said current flow.

3. An electromagnetic device as in claim 2 which further comprises switch means adapted for connection to a load circuit, said switch means actuated by said armature in pivoting between contact with said ferromagnetic core.

* * * * *

UNITED STATES PATENT AND TRADEMARK OFFICE

CERTIFICATE OF CORRECTION

PATENT NO. : 4,437,081

DATED : March 13, 1984

INVENTOR(S) : Gerald A. Wyatt

It is certified that error appears in the above—identified patent and that said Letters Patent is hereby corrected as shown below:

Col. 3, line 54, "forromagnetic" should read --ferromagnetic--

Col 4, line 47, "would" should read --wound--

Signed and Sealed this

Fourth Day of September 1984

[SEAL]

*Attest:*

GERALD J. MOSSINGHOFF

*Attesting Officer*

*Commissioner of Patents and Trademarks*